US008844786B2

(12) United States Patent
Stackhouse, Jr.

(10) Patent No.: US 8,844,786 B2
(45) Date of Patent: Sep. 30, 2014

(54) CROSS-TIE PRE-PLATE APPARATUS

(76) Inventor: Raymond W. Stackhouse, Jr., Hopewell Jct., NY (US)

( * ) Notice: Subject to any disclaimer, the term of this patent is extended or adjusted under 35 U.S.C. 154(b) by 495 days.

(21) Appl. No.: 13/340,806

(22) Filed: Dec. 30, 2011

(65) Prior Publication Data

US 2013/0168430 A1 Jul. 4, 2013

(51) Int. Cl.
*B27F 7/00* (2006.01)
*B27M 3/34* (2006.01)
*B31B 13/60* (2006.01)

(52) U.S. Cl.
USPC ..... 227/39

(58) Field of Classification Search
USPC ..... 227/175.1–182.1, 39
See application file for complete search history.

(56) References Cited

U.S. PATENT DOCUMENTS

| | | | | |
|---|---|---|---|---|
| 3,405,649 | A | 10/1968 | Foxx et al. | |
| 3,701,320 | A | 10/1972 | Fearon | |
| 3,713,396 | A | 1/1973 | Colius | |
| 3,728,968 | A | 4/1973 | Rymes | |
| 3,783,773 | A | 1/1974 | Willard | |
| 4,178,671 | A | 12/1979 | Luttig | |
| 4,280,613 | A | 7/1981 | Stewart | |
| 4,691,639 | A | 9/1987 | Holley | |
| 4,911,599 | A | 3/1990 | Theuer | |
| 4,942,822 | A | 7/1990 | Cotic | |
| 5,331,899 | A | 7/1994 | Holley | |
| 5,343,606 | A | 9/1994 | Girouard | |
| 5,415,087 | A | 5/1995 | Sniffen | |
| 5,528,807 | A | 6/1996 | Girouard | |
| 5,655,455 | A | 8/1997 | Smith | |
| 5,671,679 | A | 9/1997 | Straub | |
| 5,813,103 | A | 9/1998 | Girouard | |
| 6,089,162 | A | 7/2000 | Madison | |
| 6,119,327 | A | 9/2000 | Girouard | |
| 6,131,272 | A | 10/2000 | Girouard | |
| 6,134,775 | A | 10/2000 | Castillo | |
| 6,292,997 | B1 | 9/2001 | Ollendick | |
| 6,543,118 | B1 | 4/2003 | Girouard | |
| 6,546,612 | B2 | 4/2003 | Ollendick | |
| 6,681,474 | B2 | 1/2004 | Ollendick | |
| 6,681,977 | B1 * | 1/2004 | Matlock | 227/152 |
| 7,497,166 | B2 | 3/2009 | Fuerst | |
| 2001/0034933 | A1 * | 11/2001 | Ollendick et al. | 29/430 |
| 2003/0061697 | A1 * | 4/2003 | Ollendick et al. | 29/430 |

* cited by examiner

*Primary Examiner* — Robert Long
(74) *Attorney, Agent, or Firm* — Heslin Rothenberg Farley & Mesiti P.C.

(57) ABSTRACT

A railroad cross-tie pre-plating apparatus for fastening at least two tie-plates to a cross-tie may include a cross-tie conveyor comprising a first end and a second end, with a cross-tie positioning mechanism positioned proximate the second end. The cross-tie positioning mechanism may include a stop member configured to prevent the movement of the cross-tie and a positioning rail positioned on a lateral side of the cross-tie conveyor. The cross-tie positioning mechanism may also include a positioning member configured to position the cross-tie against the positioning rail. The apparatus may also include at least two tie-plate positioning mechanisms, each configured to position at least one tie-plate on a cross-tie. The apparatus may also include a gauge positioned superior to the cross-tie positioning mechanism to hold the at least two tie-plates in position relative to one another as the at least two tie-plates are spiked.

19 Claims, 14 Drawing Sheets

CROSS-TIE PRE-PLATE APPARATUS

BACKGROUND

A cross-tie is a generally rectangular item that is used to support the rails of railroad tracks. Cross-ties transfer the load of the railroad to the track ballast and subgrade and maintain the rails in the correct relative orientation and gauge. Cross-ties are typically comprised of wood, although they may be comprised of other materials, such as concrete, plastic, steel and others. Cross-ties also include plates that are positioned on the tie and are secured in place using railroad spikes. In typical applications, two plates will be secured to a cross-tie. Additional plates may be affixed to a cross-tie if needed. The two plates must be spaced apart by the distance between the two rails. The uniform distance between the plates, and consequentially the rails, is preferred. Railroad rails include a broad lower portion that fits within the railroad plate. Spikes are driven through the plate and include an offset head that secures the rail to the plate and to the cross-tie.

In some applications, particularly where a track is being repaired, cross-ties will be prepared at the work site immediately before they are used. In repairing track, it is often necessary to set each plate separately as the rail is laid into it. In other applications, particularly those involving new lines of railroad track, cross-ties can be prepared in a large quantity. They can be prepared either at the work site, or alternatively can be prepared at a distant location and transported to the site. The process of affixing plates to cross-ties before they are used on the railroad track is commonly referred to as pre-plating.

Wooden cross-ties are roughly cut and typically do not conform to uniform dimensions. Cross-ties are not rigorously sorted and therefore bundled with varying grades resulting in cross-ties with slightly different dimensions being pre-plated at the same time. The cross-ties are not exactly the same and the pre-plating process of cross-ties is complicated because the slight variations require different placement of the plates on the cross-ties. Although the cross-ties themselves can vary in dimensions, it is necessary for the plates to be accurately positioned. That is, it is necessary for the plates themselves to be parallel to one another and the distance between the plates to be uniform for each of the ties. It is preferable for each of the plates to be laterally centered on the cross-tie and the first plate positioned a set distance from the first end or line side. Because the cross-ties have varying widths and lengths the plates are not placed in the same exact position on the cross-tie. Slight variations in the cross-ties require slightly different placement of the plates. Although the plates are placed in slightly different locations on the cross-tie, it is still necessary that they remain separated by the appropriate distance and be substantially parallel.

SUMMARY

The invention provides, in one aspect, a railroad cross-tie pre-plating apparatus for fastening at least two tie-plates to a cross-tie. The apparatus may include a cross-tie conveyor comprising a first end and a second end. The apparatus may include a cross-tie positioning mechanism positioned proximate the second end. The cross-tie positioning mechanism may include a stop member configured to prevent the movement of the cross-tie along the cross-tie conveyor. The cross-tie positioning mechanism may also include a positioning rail positioned on a lateral side of the cross-tie conveyor. The cross-tie positioning mechanism may also include a positioning member configured to position the cross-tie against the positioning rail. The cross-tie pre-plating apparatus may also include at least two tie-plate positioning mechanisms, each configured to position at least one tie-plate on a cross-tie. The tie-plate positioning mechanisms may include a tie-plate positioning member configured to engage the tie-plate and position the tie plate on the cross-tie. The apparatus may also include a gauge positioned superior to the cross-tie positioning mechanism and configured to hold the at least two tie-plates in position relative to one another as the at least two tie-plates are spiked to the cross-tie.

The cross-tie pre-plate apparatus, according to another aspect of the invention, may also include an in-feed system. The in-feed system may include an in-feed conveyor configured to support a plurality of cross-ties and to move the cross-ties toward the cross-tie conveyor. The in-feed system may also include an in-feed stop member connected to the in-feed conveyor and configured to selectively prevent the motion of cross-tie toward the cross-tie conveyor. The in-feed stop member may be rotatably connected to the in-feed conveyor. The in-feed stop member may be hydraulically rotatable. The in-feed conveyor may be substantially perpendicular to the cross-tie conveyor.

According to another aspect of the invention, the apparatus may further comprise an out-feed system. The out-feed system may include an out-feed conveyor positioned in line with the cross-tie conveyor and configured to receive the cross-tie with at least two tie-plates affixed thereto. The out-feed system may also include a finished cross-tie conveyor configured to receive the cross-tie with at least two tie-plates affixed thereto. The out-feed system may also include a lifting mechanism engaging the out-feed conveyor and configured to lift the out-feed conveyor to move the cross-tie with at least two tie-plates affixed thereto into the finished cross-tie conveyor. The lifting mechanism may include a hydraulic cylinder.

According to another aspect of the invention, the apparatus may also include at least one control mechanism attached to the cross-tie conveyor and configured to manipulate the apparatus. The apparatus may include at least one guard connected to the cross-tie conveyor and disposed above the at least one control mechanism, the at least one guard selectively positionable in at least two positions, including a first position and a second position. In the first position, the guard may be disposed above the at least one control mechanism. In the second position the guard may be perpendicularly disposed in front of at least one of the cross-tie positioning mechanisms.

According to another aspect of the invention, the stop member may include at least one stop shim removably mounted on the stop member and configured to control the position of the cross-tie on the cross-tie conveyor. The positioning member may include a generally cylindrical member oriented parallel to the positioning rail. The positioning member may include a hydraulic cylinder connected to the cylindrical member and configured to position the generally cylindrical member against the positioning rail.

According to another aspect of the invention, the at least two tie-plate positioning mechanisms may each include a hydraulic cylinder connected to the tie-plate positioning member and be configured to position the tie-plate on the cross-tie. The at least two tie-plate positioning mechanisms may also include a tie-plate container configured to retain at least two vertically stacked tie-plates.

According to another aspect of the invention, the gauge may include at least two plate engaging portions having a width substantially equal to the width of a railroad rail and a gauge member connected to the at least two plate engaging portions. The length between the at least two plate engaging portions may be substantially equal to the distance between two railroad rails.

The apparatus may also include a diesel engine coupled to a hydraulic pump and configured to supply hydraulic fluid. The apparatus may also include at least one hydraulic cooler coupled to the hydraulic pump and configured to cool the hydraulic fluid. The apparatus may also comprise frame connected to and supporting the cross-tie conveyor and the at least two plate positioning mechanisms.

Other additional features and benefits will become apparent from the following drawings and descriptions of the invention. Other embodiments and aspects of the invention are described in detail herein and are considered a part of the claimed invention.

BRIEF DESCRIPTION OF THE DRAWINGS

The subject matter which is regarded as the invention is particularly pointed out and distinctly claimed in the claims at the end of the specification. The foregoing and other objects, features, and advantages of the apparatus are apparent from the following detailed description taken in conjunction with the accompanying drawings in which:

DETAILED DESCRIPTION

Figure 1:
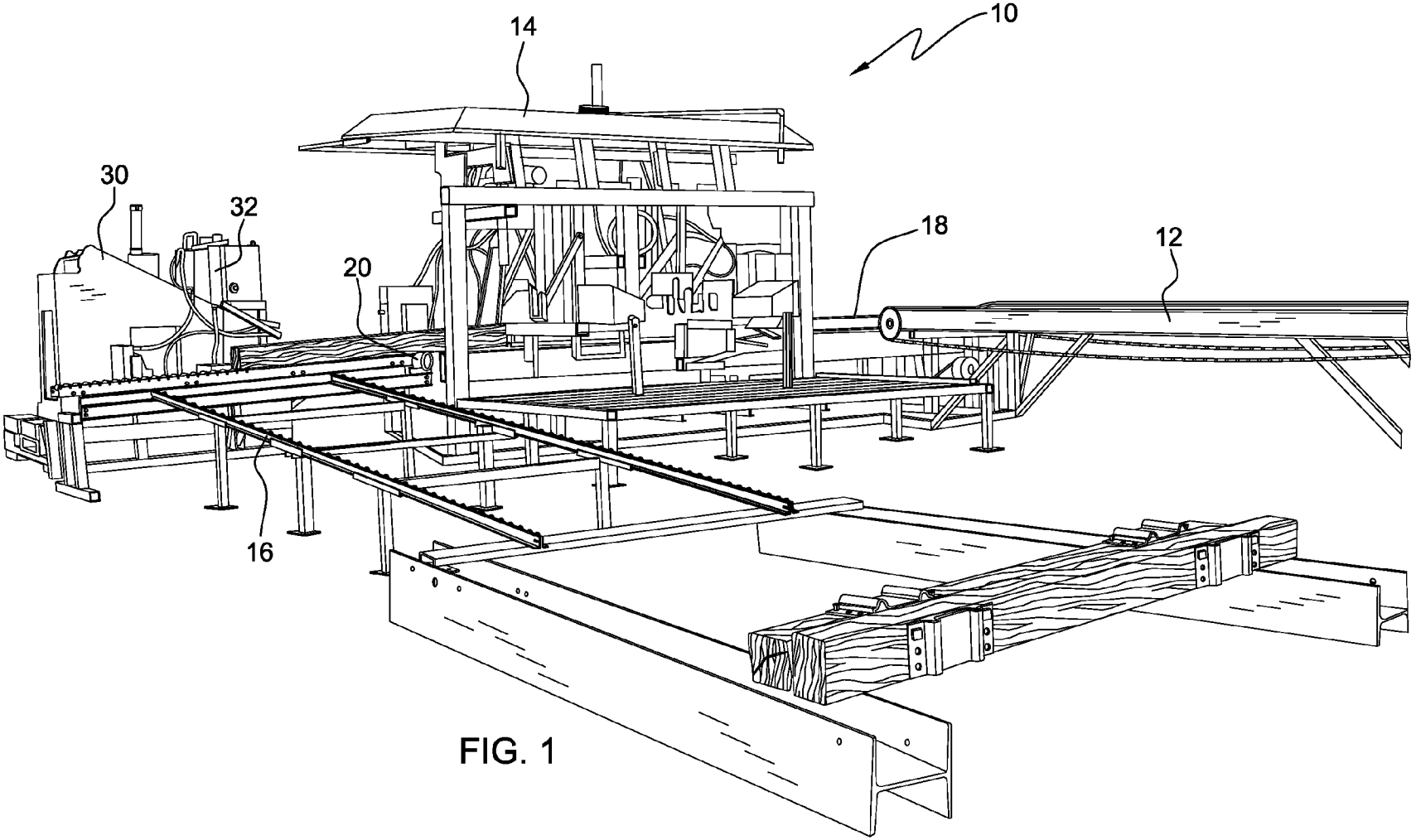
FIG. 1 is a perspective view of the cross-tie pre-plate apparatus; in accordance with an aspect of the invention.

For the purposes of promoting an understanding of the principles of the cross-tie pre-plate apparatus, reference will now be made to the embodiments, or examples, illustrated in the drawings and specific language will be used to describe these. It will nevertheless be understood that no limitation of the scope of the apparatus is thereby intended. Any alterations and further modifications in the described embodiments, and any further applications of the principles as described herein are contemplated as would normally occur to one skilled in the art to which the cross-tie pre-plate apparatus relates.

In this detailed description and the following claims, the words lateral, longitudinal, superior and inferior, are defined by their standard usage for indicating particular part of a cross-tie or the cross-tie pre-plating apparatus, the relative disposition of the cross-tie or the cross-tie pre-plating apparatus, or directional terms of reference. For example, lateral indicates at the sides of the narrower dimensions of a cross-tie, while longitudinal indicates aspects relative to the length rather than the width of the cross-tie. Superior is intended to refer to an object or direction above, while inferior indicates an object or direction below another object or structure.

The operation of the cross-tie pre-plate apparatus of the present disclosure may be configured and capable of creating pre-plated cross-ties at a rate of approximately 100 per hour. In addition to this rate of production, the apparatus of the present disclosure is operated primarily by hydraulic control and is therefore not susceptible to electrical malfunction. In addition, the limited number of moving parts provides for a simple operation. The interchangeability of various elements allows for the apparatus to be quickly and easily adapted for various cross-tie specifications.

One embodiment of cross-tie pre-plate apparatus constructed in accordance with one or more aspects of the present disclosure is depicted in FIG. 1. Apparatus 10 may include an infeed conveyor system 12, a plate affixing mechanism 14 and an outfeed conveyor system 16. Cross-ties are placed on the infeed conveyor system 12 by a wheel loader or other known means of depositing cross-ties and the cross-ties are then pulled toward the plate affixing mechanism 14. Infeed conveyor system 12 may be positioned at a first end 18 of plate affixing mechanism 14. Cross-ties travel along the infeed conveyor system 12 and are deposited one at a time on the plate affixing mechanism 14. The plate affixing mechanism 14 is provided to affix plates to the cross-tie. The outfeed conveyor system 16 is provided to move the cross-ties away from the plate-affixing mechanism 14.

Figure 13:
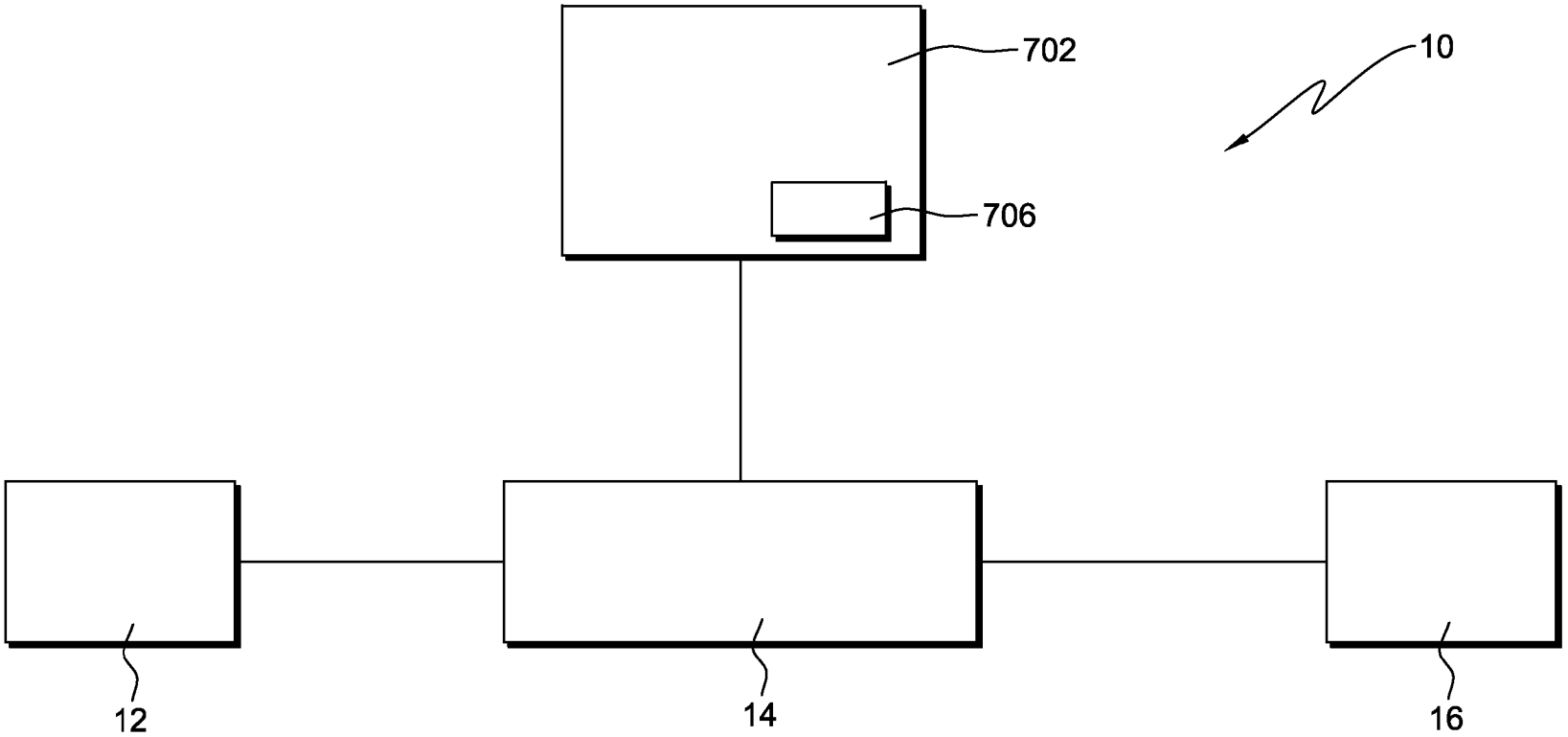
FIG. 13 is a schematic diagram of the cross-tie pre-plate apparatus of FIG. 1, in accordance with an aspect of the invention.

A schematic diagram, in accordance with an aspect of the present disclosure is depicted in FIG. 13. Apparatus 10 is shown including infeed conveyor system 12, plate affixing mechanism 14, outfeed conveyor system 16 and a plate positioning mechanism 702. As discussed in further detail herein, cross-ties are placed on infeed conveyor system 12 and are pulled toward and into plate affixing mechanism 14. Once a cross-tie is disposed within plate affixing mechanism 14, it may be positioned for tie-plates or plates to be affixed thereto. Plate positioning mechanism 702 may be disposed generally superior to or as a part of plate affixing mechanism 14. Plate positioning mechanism 702 may include a plate positioning member 706 that is configured to engage a plate and position the plate on a cross-tie.

Again referring to the example embodiment shown in FIG. 1, cross-ties are placed on infeed conveyor system 12, transported along infeed conveyor system 12, and fed into plate affixing mechanism 14. Cross-ties may be then moved along plate affixing mechanism 14 and the plates are then affixed to the cross-ties according to desired specifications. After plates have been affixed to the cross-ties, the cross-ties exit plate affixing mechanism 14 through second end 20 and are moved onto an outfeed conveyor system 16. The cross-ties may be manually removed from apparatus 10, for example with a wheel loader or other known means of removing cross-ties.

Apparatus 10 may also include a diesel engine 30. Diesel engine 30 supplies hydraulic fluid and hydraulic force to hydraulic cylinders and motors throughout apparatus 10. The various hydraulic cylinders and motors throughout the apparatus are discussed in more detail below. Hydraulic cylinders may be utilized to operate, for example, an infeed tie stop, a tie stop along the conveyor of the plate affixing mechanism, a positioning member to position a cross-tie against a rail, to lift a part of the outfeed conveyor, and/or to raise or lower the plate gauge. Hydraulic engines can be operated to pull chains or turn rotatable cylinders which in turn transport cross-ties throughout the apparatus 10. Diesel engine 30 may include a fan 32, one example of a hydraulic cooler, to cool hydraulic fluid.

According to other solutions, a cross-tie is stopped prior to entering the plate affixing mechanism as a part of the infeed conveyor system. These other solutions rely on gravity to feed the un-plated cross-ties down the infeed conveyor toward the plate affixing mechanism and associated conveyor. At the end of the infeed conveyor closest to the plate affixing mechanism, the infeed conveyor is recessed and a lip is formed on the frame of the infeed conveyor. The ties, due to gravity, come to rest against this lip. The end of the infeed conveyor is then raised to position an un-plated cross-tie above the lip and allow one cross-tie to move onto the plate affixing mechanism. Because the infeed conveyor relies on gravity, the cross-ties may not move at a rate sufficient to maximize operator time. In addition the gravity-feed nature of the infeed conveyor of these other solutions results in jamming of the cross-ties.

Figure 2:
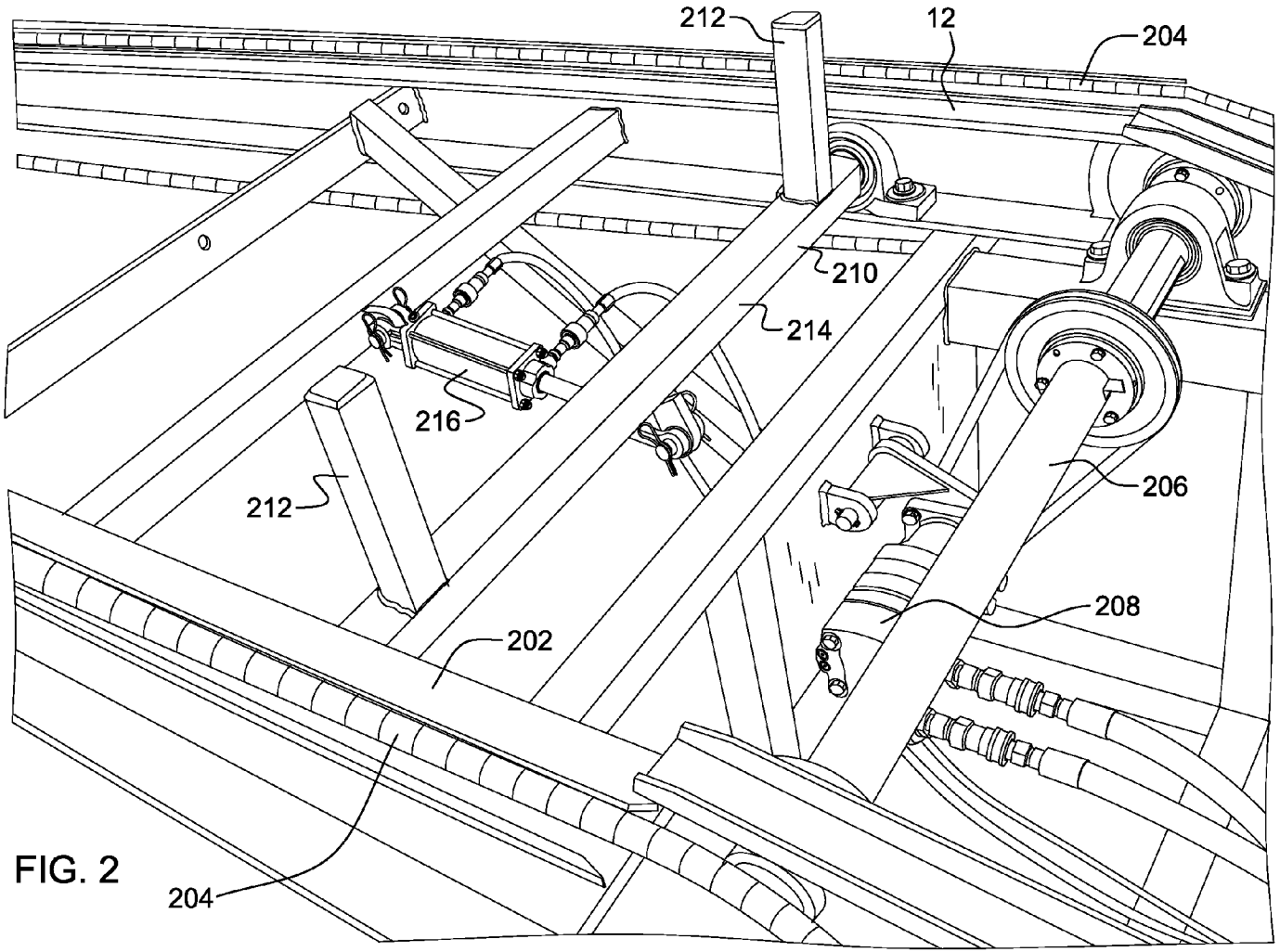
FIG. 2 is a perspective view of one end of an in-feed conveyor of the cross-tie pre-plate apparatus of FIG. 1, in accordance with an aspect of the invention.

FIG. 2 shows one embodiment of an end of infeed conveyor system 12 in accordance with an aspect of the present disclosure that is positioned next to pre-plate affixing mechanism 14. Infeed conveyor system 12 includes a frame 202 to support cross-ties. Chains 204 may be positioned on frame 202 and may be pulled by an axel 206. The rotation of axel 206 may be driven by a hydraulic motor 208. Infeed conveyor system 12 may also include an infeed tie stop 210. Infeed tie stop 210 is provided to stop the forward motion of cross-ties when a cross-tie is already placed in the plate affixing mechanism 14. Chains 204, axel 206 and hydraulic motor 208 cooperate to pull cross-ties along infeed conveyor system 12 toward pre-plate affixing mechanism 14.

Infeed tie stop 210 may be positioned at the end of infeed conveyor system 12 closest to pre-plate affixing mechanism 14. Infeed tie stop 210 may include two substantially parallel projections 212 permanently affixed to a rotatable member 214. Rotatable member 214 may be attached to a hydraulic cylinder 216. The operation of hydraulic cylinder 216 may cause the rotation of rotatable member 214 and position parallel projections 212 in a generally vertical position to stop the advancement of cross-ties. Several cross-ties may be placed on the infeed conveyor system 12 at the same time. The cross-ties may not be perfectly aligned, and are typically deposited at the end of infeed conveyor system 12 furthest from plate affixing mechanism 14. Therefore, it is necessary to advance the cross-ties along infeed conveyor system 12 toward plate affixing mechanism 14 before each of the cross-ties is brought into plate affixing mechanism 14. Infeed tie stop 210 aligns the cross-ties in approximately the proper orientation for manipulation into plate affixing mechanism 14. This alignment prevents jamming and interference when the cross-ties are brought into plate affixing mechanism 14. Cross-ties may also be spaced apart from one another when placed onto the infeed conveyor system 12. When the infeed tie stop 210 is engaged, the cross-ties can be pulled against the infeed tie stop 210 and the spaces and/or gaps between cross-ties can be eliminated. By eliminating the gaps and spaces cross-ties are quickly brought into plate-affixing mechanism 14.

Figure 3:
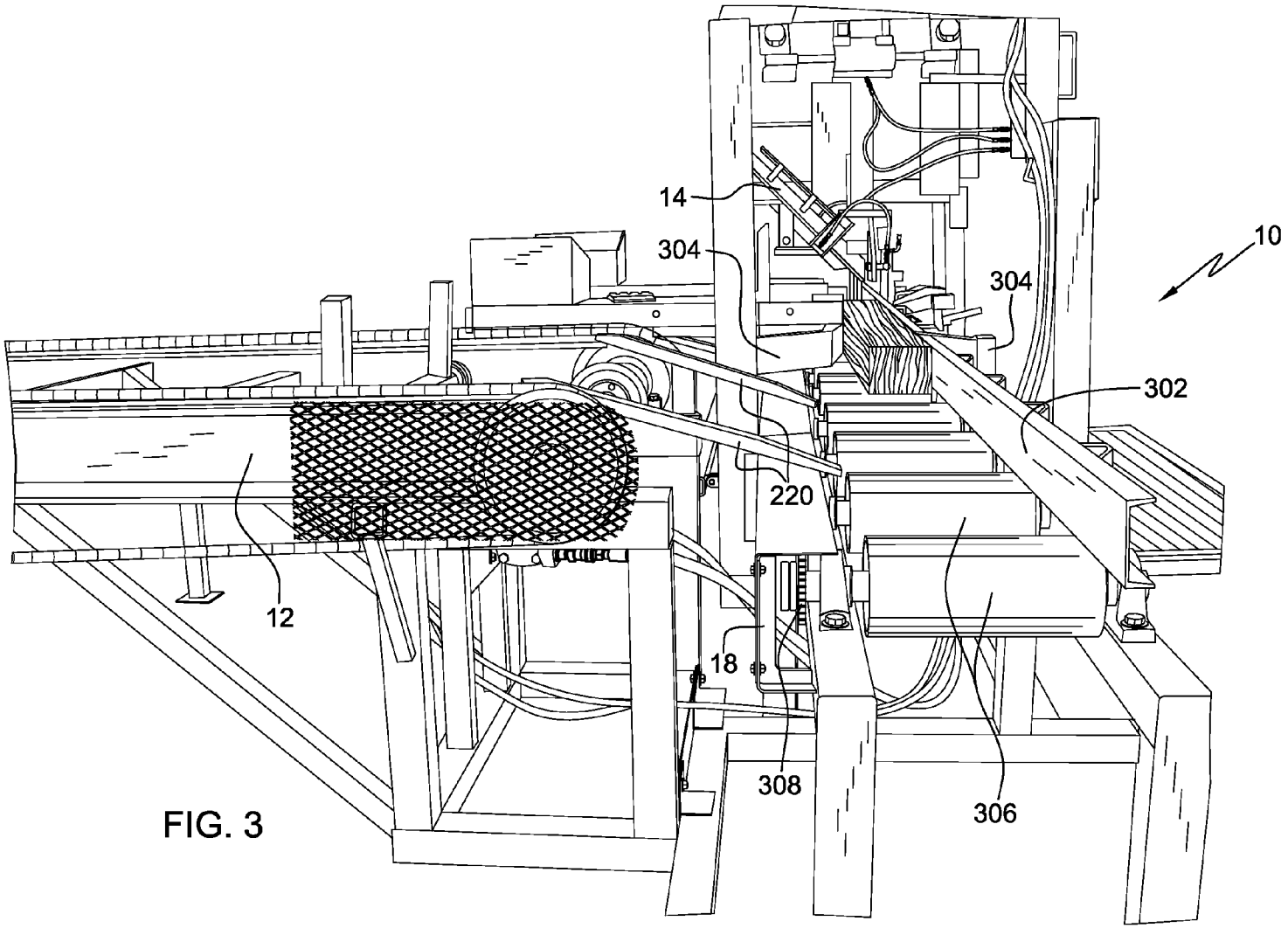
FIG. 3 is a perspective view of an in-feed conveyor and a plate affixing mechanism of the cross-tie pre-plate apparatus of FIG. 1, in accordance with an aspect of the invention.

FIG. 3 depicts an example of one end of infeed conveyor 12 and first end 18 of plate affixing mechanism 14 constructed in accordance with the principles of the present disclosure. Infeed conveyor 12 may include a tie guide member 220 which guides the cross-tie from infeed conveyor 12 to plate affixing mechanism 14. At first end 18, a rail 302 may be provided to stop a cross-tie from falling off of the apparatus 10. Rail 302 also operates as a guide to orient the cross-tie. A cross-tie may also be positioned against rail 302 to provide for smooth and easy introduction into plate affixing mechanism 14. First end 18 may also include introduction guides 304, which may be angled members to guide the cross-tie into plate affixing mechanism 14. In addition, first end 18 may also have a rotatable cylinder 306. Rotatable cylinder 306 may be provided to support a cross-tie and may rotate to move the cross-tie along plate affixing mechanism 14. Rotatable cylinder 306 may be rotated by a chain 308, which is in turn attached to and rotated by a hydraulic motor (not shown). As shown, a plurality of rotatable cylinders 306 may be placed in series for the support and transport of cross-ties. Other means of conveying a cross-tie through a plate affixing mechanism such as, for example, a conveyor or a low-friction surface are within the scope of the disclosure.

In other pre-plate apparatuses, an operator is required to move a cross-tie to the proper position for plating based on sight alone. The operator can reposition the tie by operating the rollers or other conveying means in reverse. However, that does not guarantee uniform positioning of the plates relative to the first end or line side of the cross-tie. As a consequence, the plates are not always the same distance from the line side of the cross-tie. This results in uncertainty and imprecise placement when arranging cross-ties as a part of a railroad track.

Figure 4:
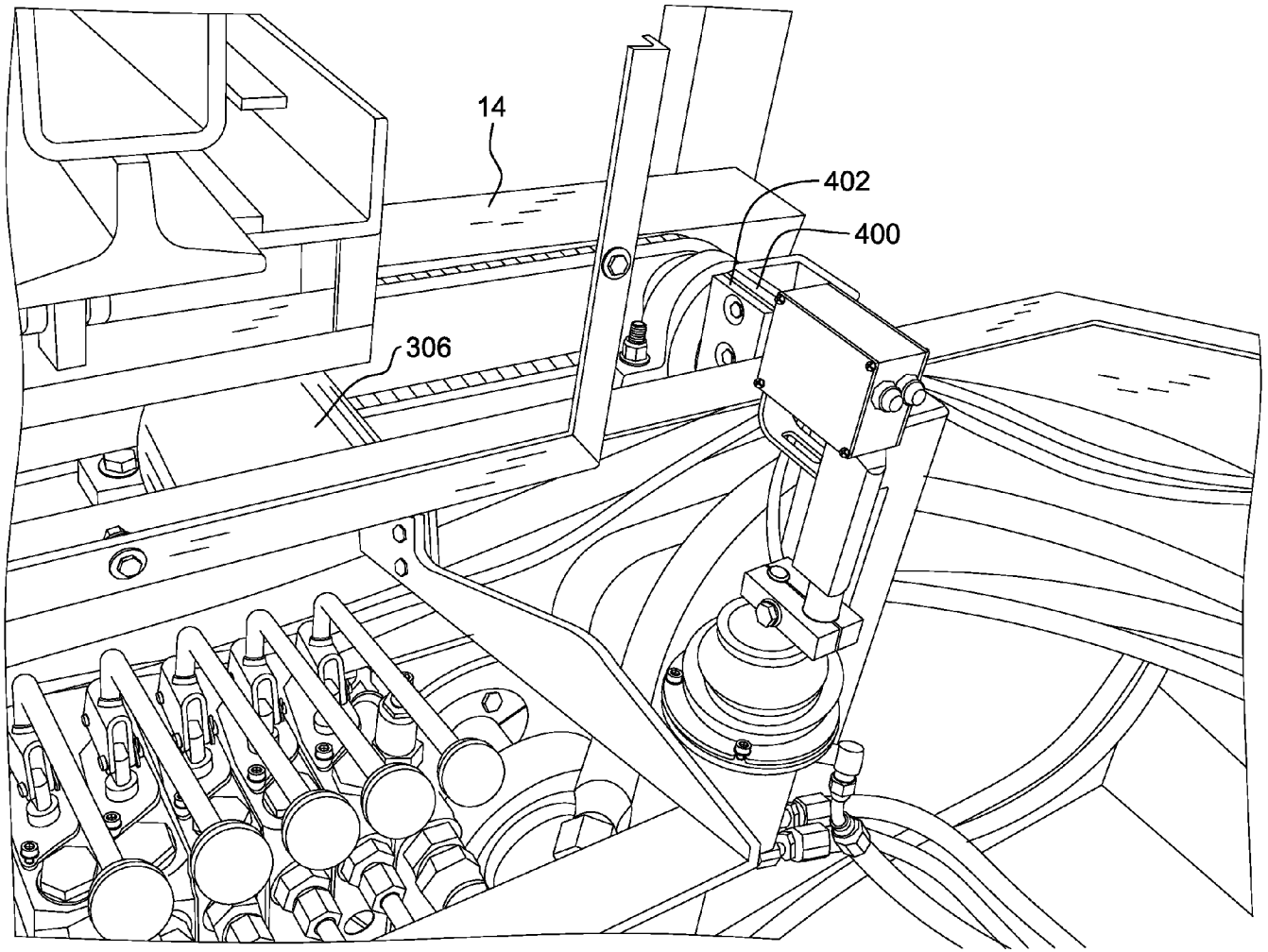
FIG. 4 is a perspective view of a plate affixing mechanism and a cross-tie stop of the cross-tie pre-plate apparatus of FIG. 1, in accordance with an aspect of the invention.

One example of a plate affixing mechanism 14 of the present disclosure where the tie stop 400 is placed in an extended position is shown in FIG. 4. Tie stop 400 may be positioned in an upright position as shown in FIG. 4, and aligned to stop a cross-tie from moving through plate affixing mechanism 14. Tie stop 400 is positioned in the extending position to stop the progress of the cross-tie through the plate affixing mechanism 14. Tie stop 400 positions the cross-tie at the appropriate position for proper plate positioning. Alternatively, tie stop 400 may be hydraulically operated so that it is inferior to the path of the cross-tie such that it does not stop the forward motion of a cross-tie caused by rotating cylinder 306 (not shown), and principally to permit the passage of a plated cross-tie to exit the plate affixing mechanism 14. Tie stop 400 may include at least one tie stop shim 402. Tie stop shim 402 is removably attached to tie stop 400 to alter the positioning of a cross-tie. The dimensions of tie stop shim 402 may be varied in order to position cross-ties at different positions within the plate affixing mechanism 14. It may be necessary to adjust the position of the cross-tie relative to the position of the plates. The first plate is positioned relative to line side of the cross-tie which is in contact with tie stop 400. The distance between the end of the cross-tie and the plate can be adjusted by the addition of tie stop shim 402 which changes the resting position of the cross-tie. The tie stop 400 may be hydraulically operated between the operative position capable of engaging the cross-tie and the inferior position (not shown).

In other solutions, a top inverted u-shaped template and a bottom u-shaped template are provided for the lateral positioning of the cross-tie. The top template engages the top portion of the cross-tie, and the bottom template engages the bottom portion of the cross-tie. The templates are coupled together and in cooperation with a spring, the cross-tie is positioned for the placement of plates.

Figure 5:
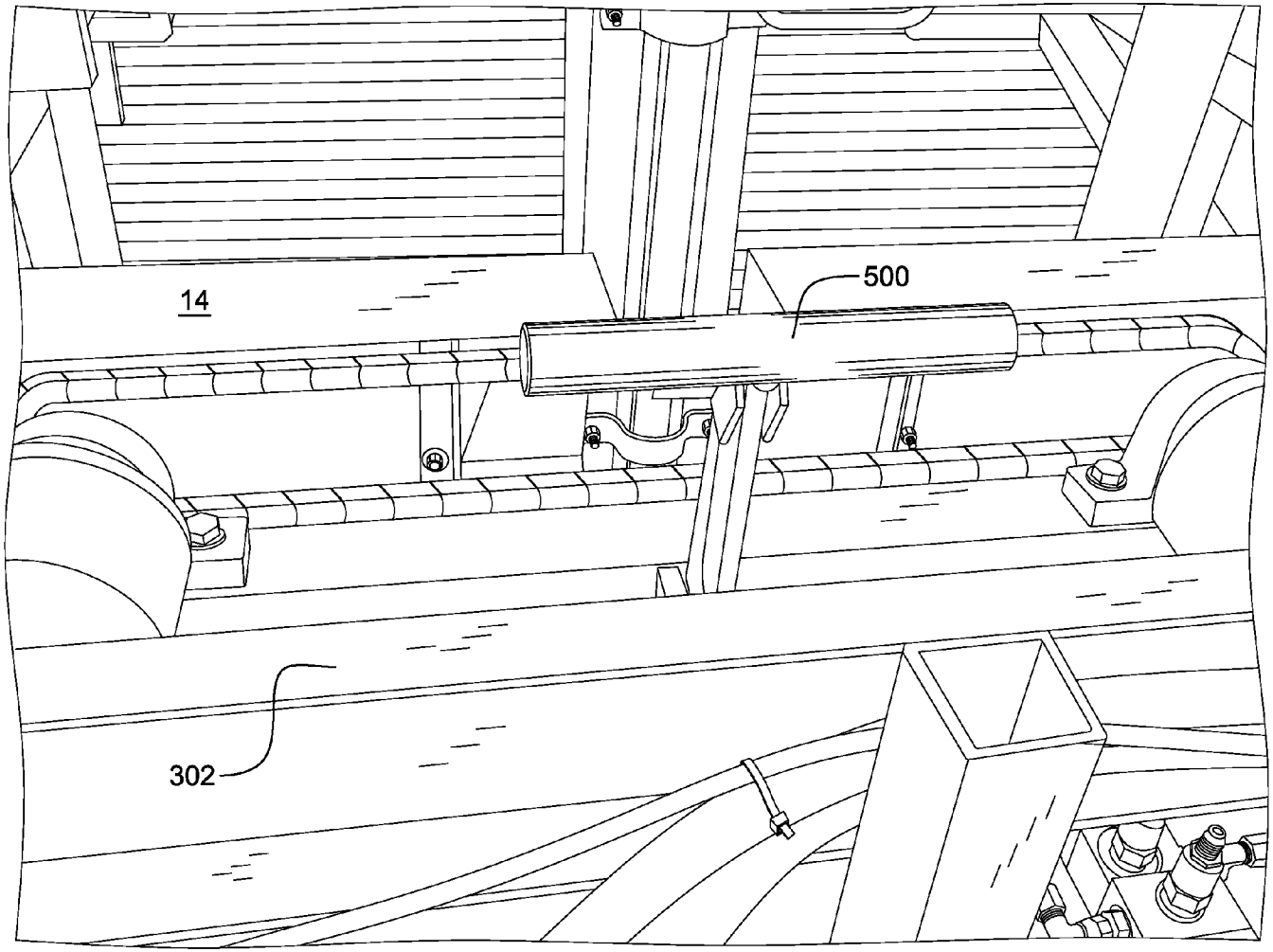
FIG. 5 is a front view of a cross-tie positioning member of the cross-tie pre-plate apparatus of FIG. 1, in accordance with an aspect of the invention.

One example of a tie positioning member 500, which is located within the plate affixing mechanism 14, in accordance with the principles of the present disclosure, is shown in FIG. 5. Initially, tie positioning member 500 is positioned away from the path of the cross-tie as the cross-tie is advanced through the plate affixing mechanism 14. Tie positioning member 500 may then be moved to contact the cross-tie and to bring the cross-tie into contact with rail 302. In this way the cross-tie is appropriately positioned such that the plates can easily and quickly be placed on the cross-tie such that they are certain to be parallel and have the proper orientation with respect to the cross-tie. The tie positioning member 500 may be operatively connected to a hydraulic cylinder (not shown). The hydraulic cylinder may be connected to the inferior aspect of tie positioning member 500, and operative to rotate tie positioning member 500 into contact with the cross-tie. Alternatively, tie positioning member 500 may be connected to the hydraulic cylinder which may move the tie positioning member in a lateral fashion to push the cross-tie against rail 302. The positioning of the cross-tie against rail 302 by tie positioning member 500 and tie stop 400 (shown in FIG. 4) causes the cross-tie to be in a uniform home position which allows the operators of the apparatus 10 to easily place plates on cross-ties.

In other pre-plate machines, the relative positioning of the plates is provided by gravity fed plate conveyors. Two gravity plate conveyors each dispense a plate in the approximate position on a cross-tie. The plates are then individually and separately manipulated by a complex means of positioning the plates relative to the cross-tie. The plates are positioned by a template which at least in part surrounds the plate and a positioning mechanism that pushes the plate within the template. However, the distance between the plates and the parallel orientation of the plates is compromised because the plates are separately adjusted.

Figure 7:
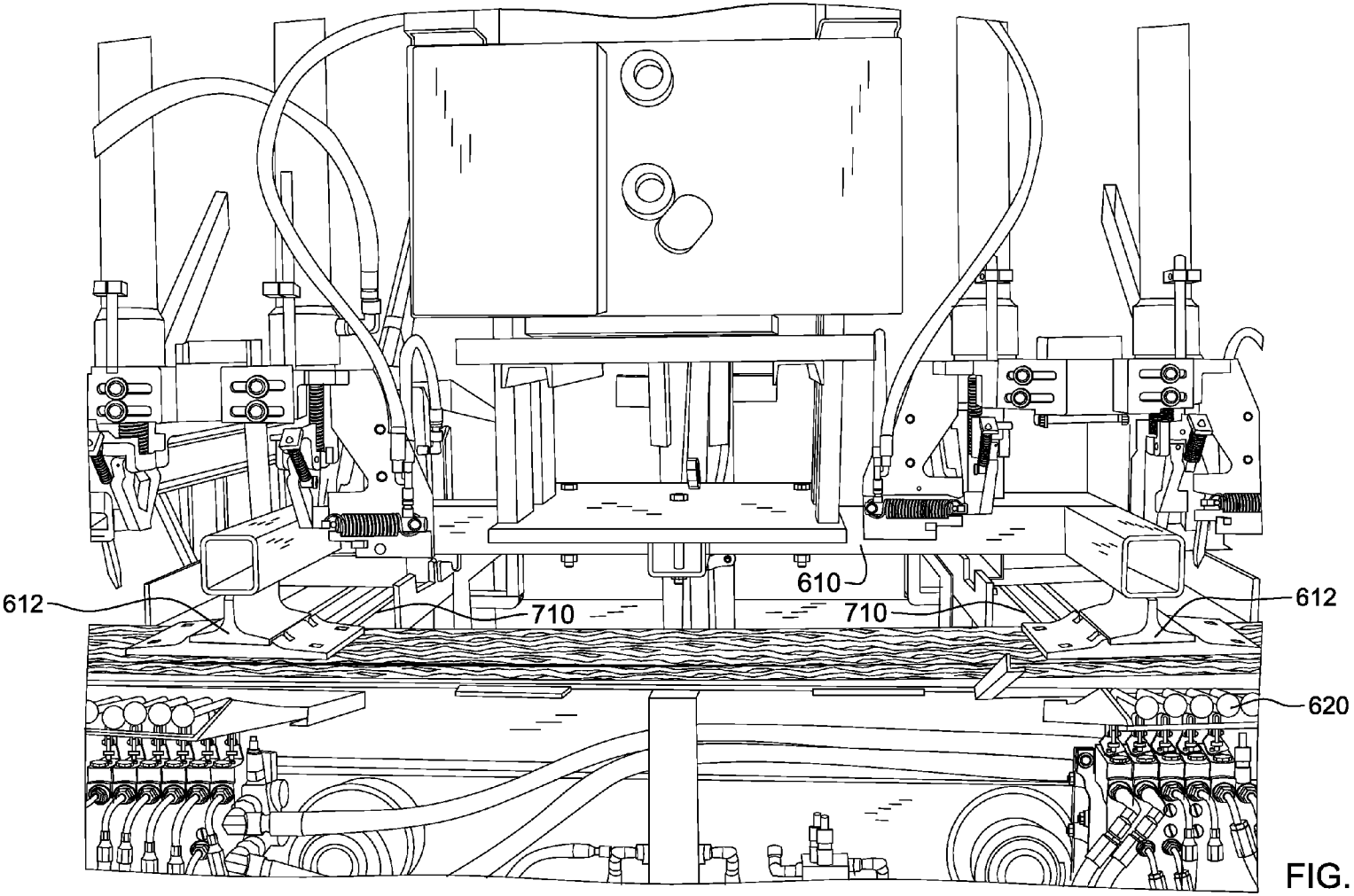
FIG. 7 is a perspective view of the spiking mechanism and a gauge of the cross-tie pre-plate apparatus of FIG. 1, the gauge engaging two tie-plates, in accordance with an aspect of the invention.
Figure 11:
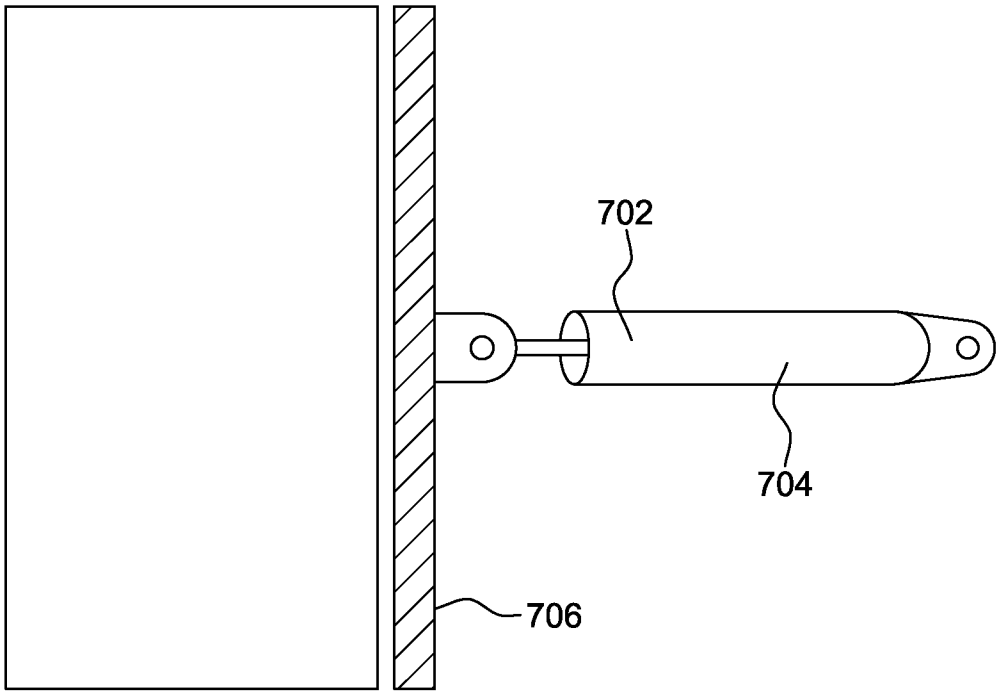
FIG. 11 is a top view of a tie-plate positioning mechanism of the cross-tie pre-plate apparatus of FIG. 1, in accordance with an aspect of the invention.

FIG. 7 depicts a view of a plate affixing mechanism 14, constructed in accordance with one of the aspects of the present invention. Here, plates have been positioned on the cross-tie. The plates are positioned on the cross-tie by a plate positioning mechanism 702, which is shown in more detail in FIG. 11. Plate positioning mechanism 702 may include a hydraulic cylinder 704 and a plate positioning member 706. Plate positioning member 706, in conjunction with the hydraulic cylinder 704, may engage a plate and push the plate from the bottom of a stack of plates. Although, the plates do not necessarily have to be stacked. The operator may operate the hydraulic cylinder 704 until the plate is positioned in the center of the cross-tie. Although the operator must rely on his sight and judgment alone, he is only concerned with laterally centering the plate on the cross-tie, and does not have to align the plate with the other plate in a parallel fashion because the tie is set in the uniform home position. The hydraulic cylinder 704 also supports additional plates in the stack until the plate positioning member 706 is withdrawn and the plates are allowed to descend. After plates are affixed to the cross-tie, the cross-tie is moved out of the plate affixing mechanism 14 and down outfeed conveyor system 16 (shown in FIG. 1).

Plate positioning member 706 contacts and pushes the plate. Although there may be a mechanical connection formed between plate positioning member 706 and the tie-plate, a mechanical connection is unnecessary and may actually interfere with the positioning of the tie-plate because the connection may inadvertently catch and move the plate out of position on the cross-tie. Thus, plate positioning member 706 is formed with a profile that corresponds to the shape of the tie-plate, which will most commonly be a flat surface. The flat surface is placed against the tie-plate to push the tie-plate smoothly and uniformly into position on the cross tie. The tie-plates may then be aligned by or be positioned in alignment with a plate gauge 610 (shown in FIGS. 6 and 7 and described below). The tie-plates are pushed across a surface 710, which supports the plates in a substantially level manner.

Figure 6:
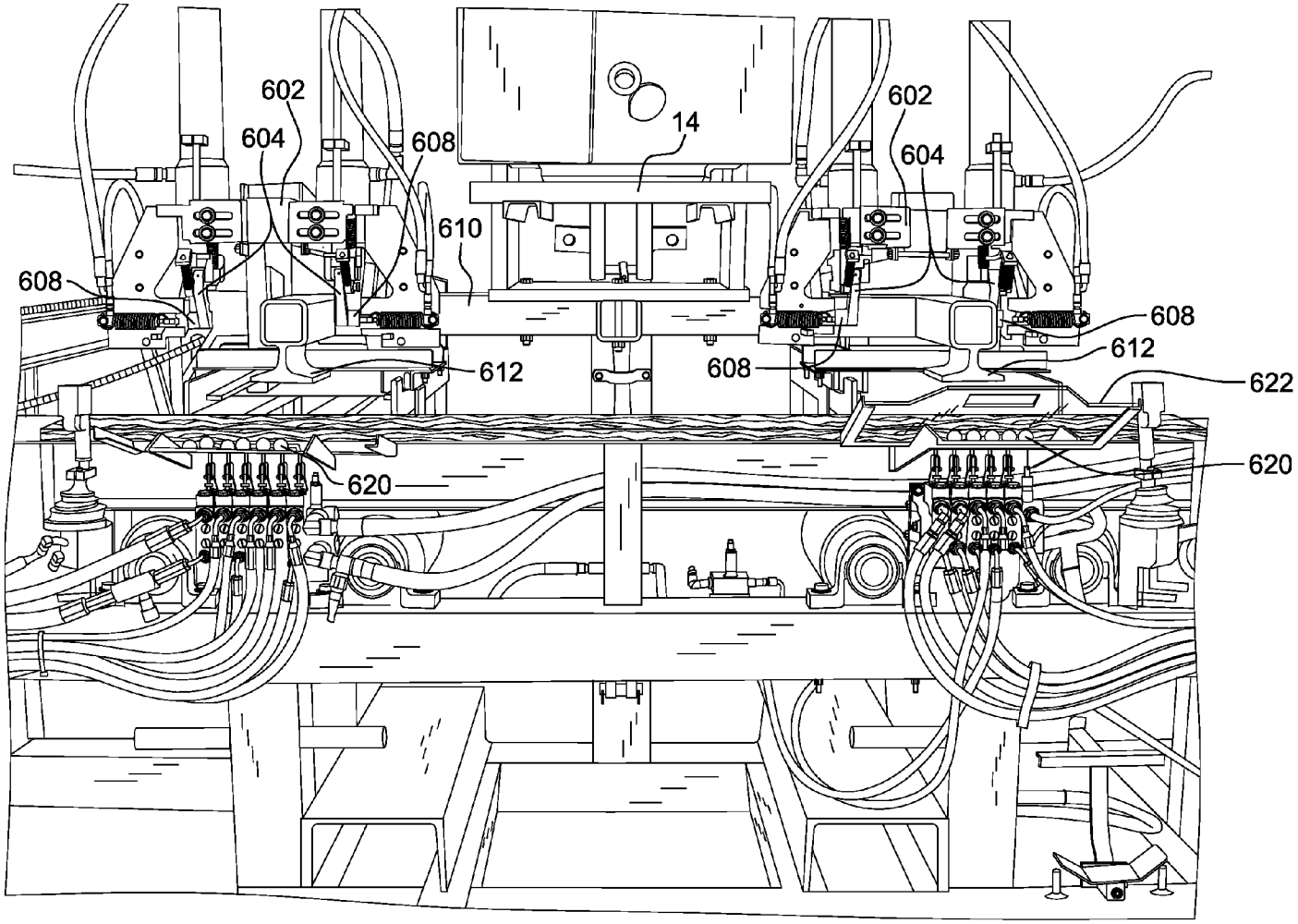
FIG. 6 is a front view of a cross-tie conveyor and two spiking mechanisms of the cross-tie pre-plate apparatus of FIG. 1, in accordance with an aspect of the invention.

FIG. 6 depicts a front view of a plate affixing mechanism 14 in accordance with an embodiment of the invention. The plate affixing mechanism 14 may include a plate gauge 610. Plate gauge 610 engages and holds two or more plates in the proper position on a cross-tie as the cross-tie is spiked. In FIG. 6, plate gauge 610 is shown in a position generally superior to a cross-tie. Plate gauge 610 is positioned above the cross-tie before the plates are positioned on the cross-tie. The plate gauge 610 therefore does not interfere with the placement of the cross-ties by the plate positioning mechanism 702 discussed above.

FIG. 7 depicts a front view of plate gauge 610 lowered and holding the plates in place on a cross-tie. In addition, small adjustments may be made to the position of the plates on the cross-tie when plate gauge 610 is lowered onto the plates. The use of plate gauge 610 ensures that the plates are spaced the appropriate distance apart, and that the plates are substantially parallel to receive the rails in parallel. Plate gauge 610 may be lowered onto the plates by a hydraulic cylinder (not shown) directly or indirectly attached to the plate gauge 610. Alternative means may be used to lower and raise the plate gauge 610.

Plate gauge 610 may include plate engaging portions 612, which are configured to engage and hold the plates. Plate gauge 610 may be configured to have a length that, when the plate engaging portions 612 hold the plates, the plates are spaced a distance apart corresponding to the distance between rails. Plate gauge 610 is removably attached to the plate affixing mechanism 14 and alternative gauges 610 may be associated with plate affixing mechanism 14. Gauge 610 positions and holds the plates in position, assuring the proper distance between the plates and the proper parallel orientation.

Figure 12:
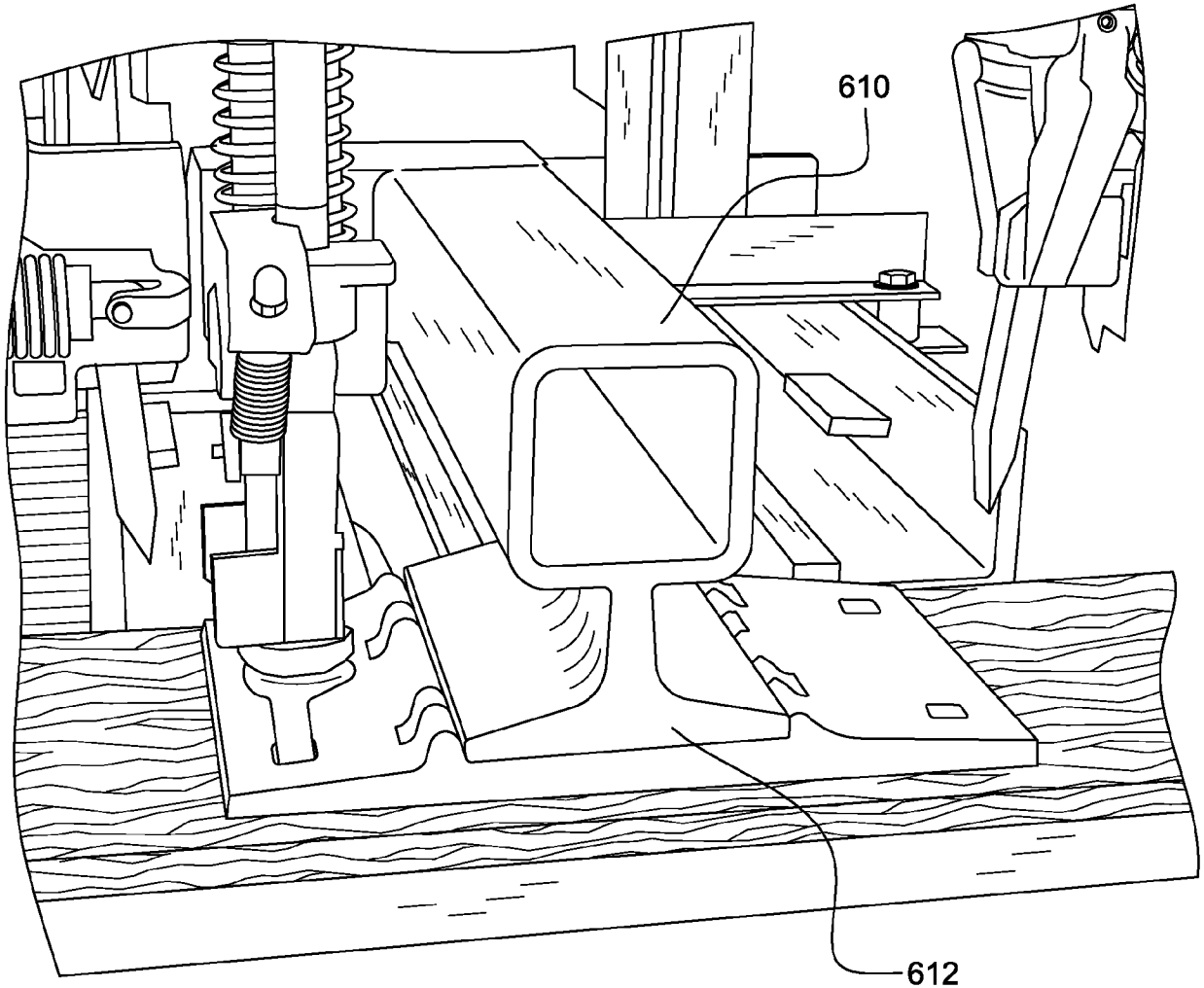
FIG. 12 is a front view of one end of the gauge holding a tie-plate as it is spiked, in accordance with an aspect of the invention.

FIG. 12 depicts one end of the plate gauge 610 holding a plate during the spiking process, in accordance with an aspect of the invention. As also shown in FIG. 7, the plate gauge 610 holds the plate on the cross-tie. One of the plate engaging portions 612 fits within the plate and holds the plate in position as spikes are driven through the plate and into the cross-tie. As shown, a variety of ports are formed in the plate that extend through the plate to receive the spikes. The plates may be spiked in at least one corner, but may be spiked in two, three or four corners. The spike may be driven so that the head of the spike rests on the plate, or alternatively, the spike may be left partially up as shown in FIG. 12. The spikes may be placed in ports that are formed close to the rail engaging portion of the plate, or alternatively in the ports formed towards the edge of the plates.

A front view of one embodiment of a plate affixing mechanism 14 is shown in FIG. 6. In this embodiment, the plate affixing mechanism 14 includes a spike driving mechanism 602. Spike driving mechanism 602 is described more fully in U.S. Pat. No. 3,405,649 to Foxx et al., issued on Oct. 15, 1968, the disclosure of which is incorporated by reference herein in its entirety. The plate affixing mechanism 14 may include two spike driving mechanisms 602, each positioned to affix a plate to a cross-tie. Briefly, each spike driving mechanism 602 may include a spike driving member 604, a spike guiding rail 606 (shown in FIG. 10), and a spike jaw 608. Railroad spikes may be placed on the guiding rail 606 and gravity fed into spike jaw 608. Spike jaw 608 may hold a spike in place until the spike driving mechanism 602 is positioned relative to the cross-tie and plate. The spike driving member 604 may then be hydraulically driven onto the spike to drive the spike through the railroad plate and into the cross-tie. The spike driving mechanism shown and described herein is shown for example purposes only, as other spike driving mechanisms may be used, including but not limited to manually driving the spikes into the plates.

The tie-plates are positioned on the cross-tie by plate positioning mechanism 702, described herein. Gauge 610 may be then be brought into contact with the plates, more specifically plate engaging portions 612 contact the plates and hold the plates on the cross-tie. Spike driving mechanism 602 then positions a spike above a port formed in the plate and brings the spike into contact with the cross-tie through the plate. For example, spike driving mechanism 602 may be hydraulically raised, lowered, laterally, and/or longitudinally moved to position the spike. The spike is then driven into the cross-tie by spike driving member 604 striking the spike. Spike driving member 602 may strike the spike a single time to push the spike to a desired depth or may strike the spike multiple times to drive the spike to the desired depth. The spike may driven completely into the cross-tie such that the head of the spike touches the plate. Alternatively, the spike may be driven partially into the cross-tie and be left in an up position, such that there is space between the head of the spike and the plate.

Figure 10:
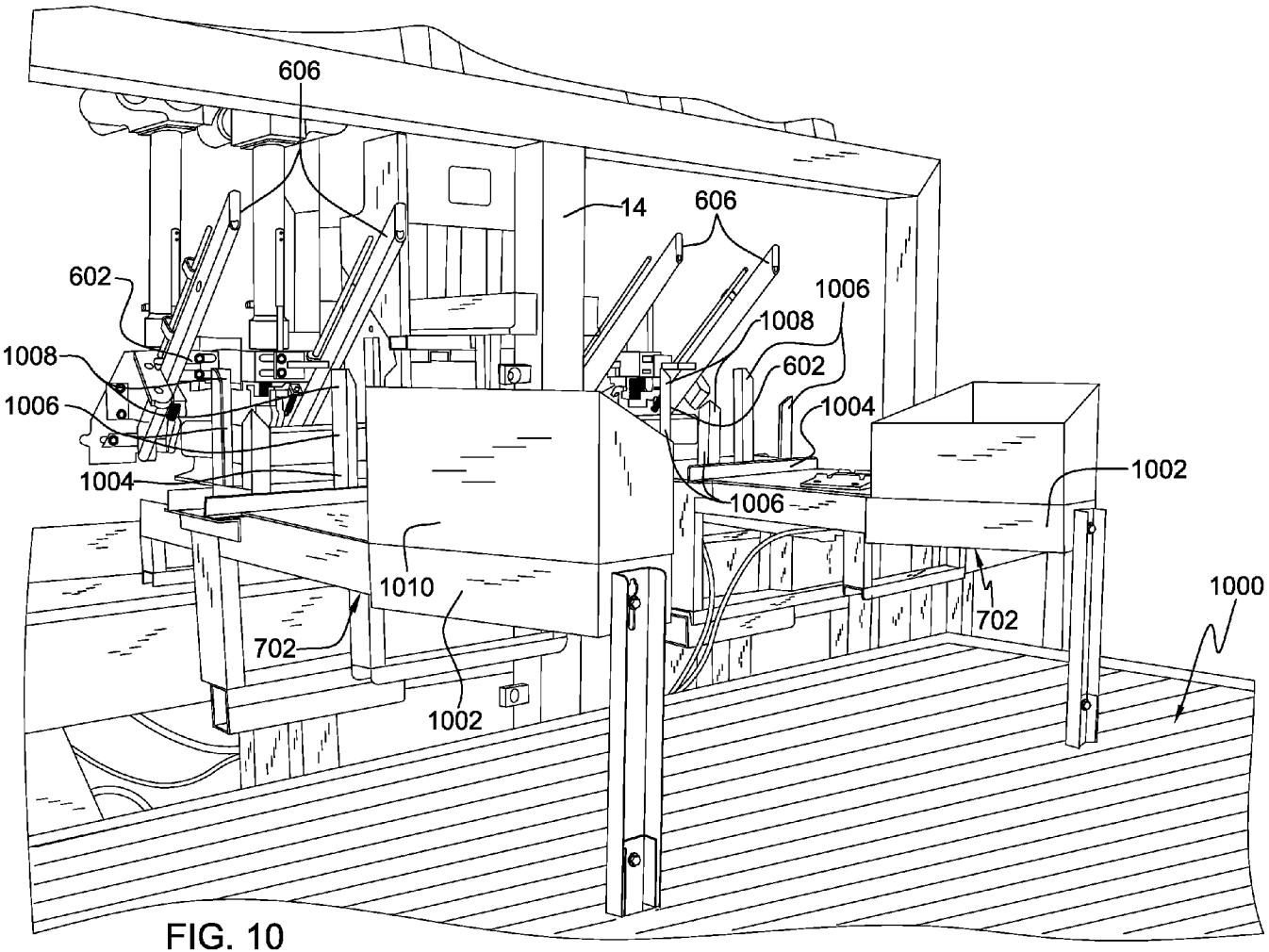
FIG. 10 is a perspective-side view of a tie-plate positioning mechanism of the cross-tie pre-plate apparatus of FIG. 1, in accordance with an aspect of the invention.

One embodiment of the back of plate-fixing mechanism 14 in accordance with the principles of the invention is shown in FIG. 10. The cross-tie pre-pate apparatus 10 may include a platform 1000, provided for access to the spike driving mechanism 602, and more specifically spike guiding rail 606. Plate fixing mechanism 14 may also include a table 1002 attached to the plate-fixing mechanism 14. Table 1002 may include a plate guide 1004 for retaining a stack of plates. Plate guide 1004 may include vertical members 1006 positioned to support a plurality of plates. Plate guide 1004 may also include a shim 1008 which may be attached to one or more of vertical members 1006. Shim 1008 may be provided to adjust the positioning of the plates within the stack to insure proper positioning of the plate on the tie. A bin 1010 may also be formed on the top of table 1002. Bin 1010 may be provided to hold spikes. Plate positioning mechanism 702 is positioned inferior and attached to table 1002. Plate positioning mechanism 702 pushes a plate from the bottom of the stack of plates within plate guide 1004.

Plate affixing mechanism 14 may also include a plurality of controls 620 and in accordance with one embodiment of the invention are shown in FIGS. 6 and 7. Controls 620 are interfaced with the hydraulic cylinders and hydraulic motors of plate affixing mechanism 14 and infeed conveyor system 12. Controls 620 regulate the amount of hydraulic fluid/pressure that is introduced into the hydraulic cylinders and engines discussed herein. The hydraulic cylinders may be operated to move, alternatively and for example purposes, an infeed tie stop, a tie stop, a tie positioning member, a plate positioning mechanism, and/or lift a portion of the outfeed conveyor system. Alternatively, one or more of the hydraulic motors may be engaged to operate the infeed conveyor and/or the plurality of rotatable cylinders. Plate affixing mechanism 14 may also include a rotatable control guard 622. Rotatable control guard 622 may be positioned in a first position as shown in FIG. 6. In the first position, the operator of plate affixing mechanism 14 is prevented from contacting plurality of controls 620. The operator can then manipulate the spike driving mechanism 602 with reduced risk of accidental operation. Potential harm to the operator is therefore reduced. Rotatable control guard 622 may be rotated to a second position, where rotatable control guard 622 is disposed between the operator and spike driving mechanism 602. In the second position, rotatable control guard 622 protects the operator from the spiking operation.

In other solutions, the cross-tie was removed from the plate-affixing mechanism by a kick or member that pushed the completed cross-tie laterally across the rollers or conveyors. Several cross-ties were then moved as a bundle by a gravity dump lifting mechanism.

Figure 8:
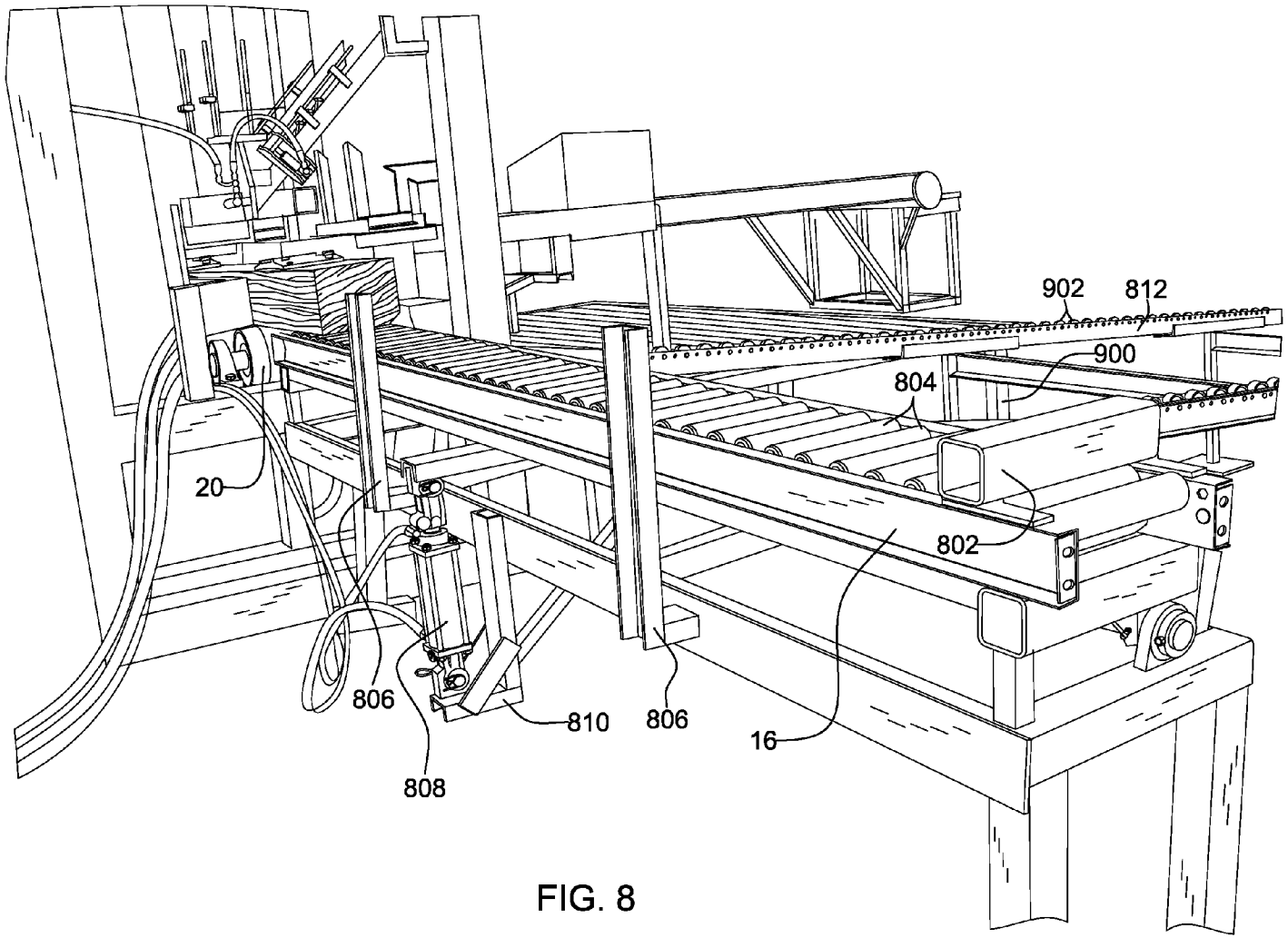
FIG. 8 is a perspective-rear view of an out-feed portion of the cross-tie pre-plate apparatus of FIG. 1, in accordance with an aspect of the invention.
Figure 9:
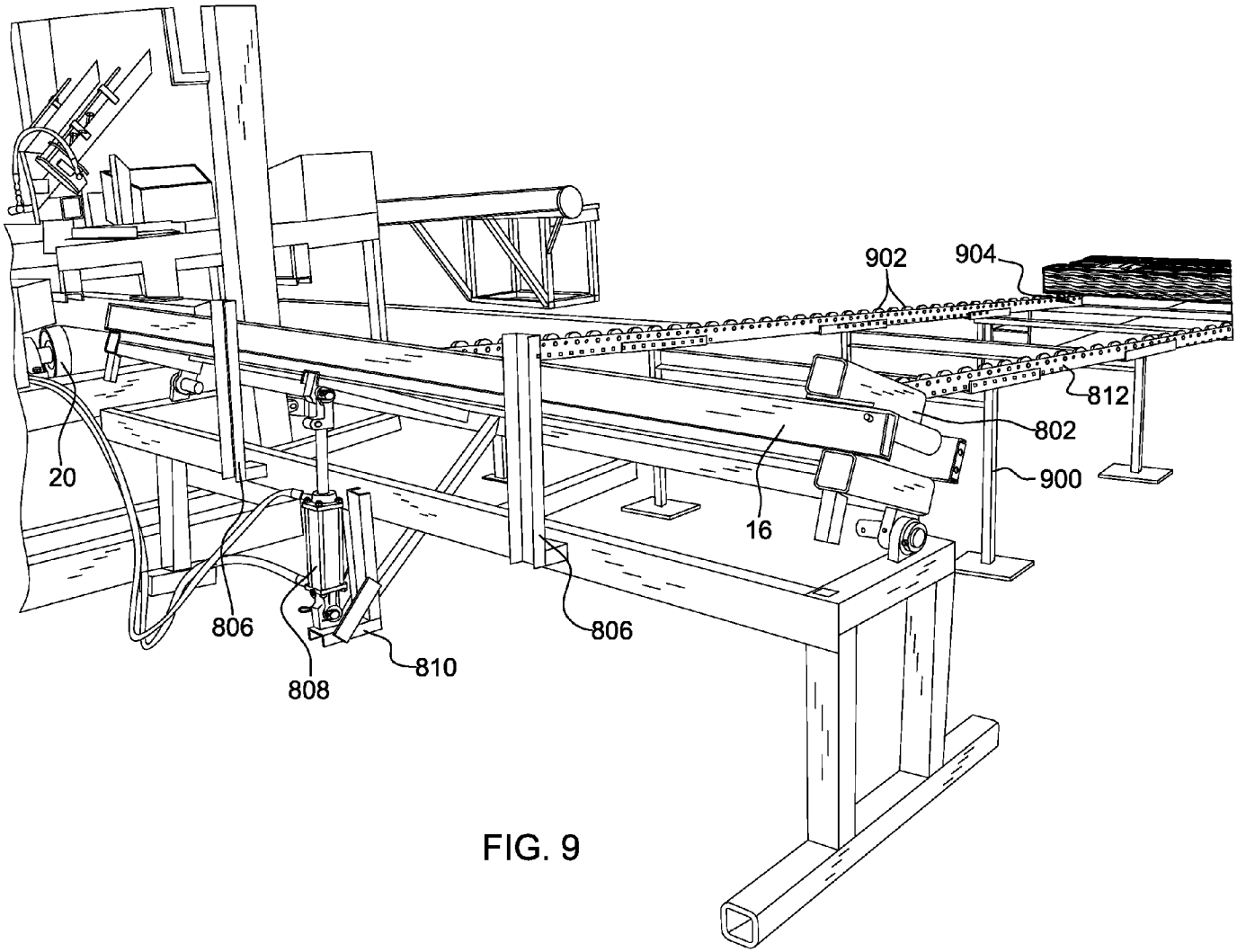
FIG. 9 is a perspective-rear view of an out-feed portion of the cross-tie pre-plate apparatus of FIG. 1, in accordance with an aspect of the invention.

FIGS. 8 and 9 depict one example of the interface between second end 20 and outfeed conveyor system 16 in accordance with an aspect of the present disclosure. A stop 802 may be positioned at the distal end of outfeed conveyor system 16 to stop the cross-tie from rolling off of the outfeed conveyor system 16. Outfeed conveyor system 16 may also include rollers 804, which freely rotate to permit the cross-tie to advance to stop 802. Outfeed conveyor system 16 may also include a substantially vertical member 806, configured to a side of outfeed conveyor 16 to prevent the cross-tie from rolling off of outfeed conveyor 16 in the improper direction. Second end 802 may also include a hydraulic cylinder 808, indirectly attached to the rollers 804 and attached to a hydraulic support 810. In FIG. 8, outfeed conveyor system 16 is shown in an orientation to receive a cross-tie with affixed plates. In FIG. 9, outfeed conveyor system 16 is shown in a lifted position that causes a cross-tie with affixed plates to slide off of the outfeed conveyor system 16 and onto an angled portion 812.

One example of outfeed conveyor system 16 may include a frame 900 and rollers 902 disposed on frame 900. The rollers are positioned to allow a cross-tie to pass to an end 904 of outfeed conveyor system 16; that is away from the plate-fixing mechanism 14. Outfeed conveyor 16 may be angled relative to the ground such that the cross-tie is moved to the other end of the outfeed conveyor system 16 and over rollers 902 by gravity. The pre-plated cross-ties can then be collected and bundled as needed for transportation or use.

According to an aspect of the invention, the cross-tie pre-plate apparatus 10 is modular and can be disassembled and easily transported to a separate location. This allows for the assembly of pre-plated railroad cross-ties at any substantially desirable location. Diesel engine 30 provides hydraulic and electric power at remote locations. In addition the infeed conveyor system 12, the plate affixing mechanism 14 and the outfeed conveyor system 16 may be disassembled and detached from one another and separately loaded onto a truck. The platform 1000 may also be detached and/or pivoted to reduce the profile of the plate affixing mechanism 10.

Figure 14:
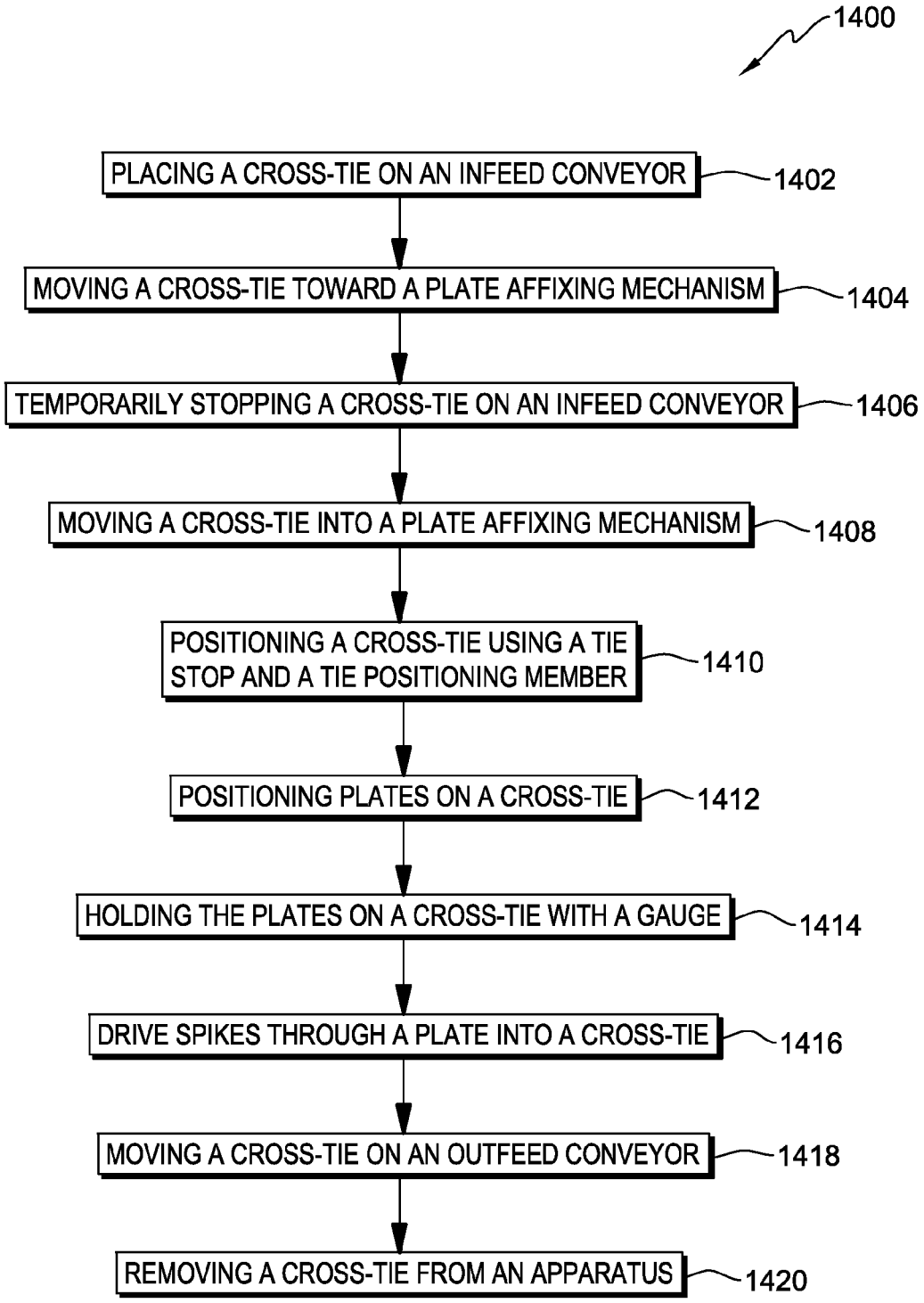
FIG. 14 is a flow diagram showing the steps of the process of pre-plating a cross-tie using the cross-tie pre-plate apparatus of FIG. 1, in accordance with an aspect of the invention.

Referring now to FIG. 14 a flow diagram depicts the method 1400 of pre-plating a cross-tie in accordance with an aspect of the invention. The steps and the order of the steps are shown for illustrative purposes and should not be considered limiting. The steps below are listed in terms of a single cross-tie but it should be understood the multiple cross-ties may be manipulated at once in some or all of the steps. Method 1400 may include the step of placing a cross-tie on an infeed conveyor 1402 using a wheel loader or other known means of loading cross-ties onto an infeed conveyor. Method 1400 may include moving a cross-tie toward a plate affixing mechanism 1404 for affixing plates onto cross-ties. Optionally, method 1400 may include temporarily stopping a cross-tie on an infeed conveyor 1406 to orient the cross-ties and to prevent the ties from jamming. Method 1400 may also include moving a cross-tie into a plate affixing mechanism 1408 so that the cross-tie may be positioned for the placement and spiking of the plates. The step of positioning a cross-tie using a tie stop and/or a tie positioning member 1410 so that the plates are aligned to be parallel and in the proper orientation, may also be included in method 1400. Method 1400 may include positioning plates on a cross-tie 1412. Method 1400 may also include holding plates on a cross-tie with a gauge 1414 so that there is no unintended movement of the plates during the spiking process. The step of driving spikes through plates into a cross-tie 1416 may also be included. Method 1400 may also include moving a cross-tie onto an outfeed conveyor 1418 to bundle and/or remove the cross-tie from the apparatus. Method 1400 may also include removing a cross-tie from an apparatus 1420.

While embodiments of the invention have been illustrated and described in detail in the disclosure, the disclosure is to be considered as illustrative and not restrictive in character. All changes and modifications that come within the spirit of the invention are to be considered within the scope of the disclosure.

The invention claimed is:

1. A railroad cross-tie pre-plating apparatus for fastening at least two tie-plates to a cross-tie, the apparatus comprising:

a cross-tie conveyor, comprising a first end and a second end;

a cross-tie positioning mechanism positioned proximate the second end, the cross-tie positioning mechanism comprising:

a stop member, configured to prevent the movement of the cross-tie along the cross-tie conveyor;

a positioning rail, positioned on a lateral side of the cross-tie conveyor; and a positioning member, configured to position the cross-tie against the positioning rail;

at least two tie-plate positioning mechanisms, each configured to position at least one of the at least two tie-plates on the cross-tie, each tie-plate positioning mechanism comprising a tie-plate positioning member, the tie-plate positioning member configured to engage the tie-plate and position the tie-plate on the cross-tie; and a gauge positioned superior to the cross-tie positioning mechanism and configured to hold the at least two tie-plates in position relative to one another as the at least two tie-plates are fastened to the cross-tie with spikes.

2. The apparatus of claim 1, further comprising an in-feed system, the in-feed system comprising:

an in-feed conveyor configured to support a plurality of cross-ties and to move the cross-ties toward the cross-tie conveyor; and an in-feed stop member connected to the in-feed conveyor and configured to selectively prevent the motion of cross-ties toward the cross-tie conveyor.

3. The apparatus of claim 2, wherein the in-feed stop member is rotatably connected to the in-feed conveyor.

4. The apparatus of claim 3, wherein the in-feed stop member is hydraulically rotatable.

5. The apparatus of claim 2, wherein the in-feed conveyor is substantially perpendicular to the cross-tie conveyor.

6. The apparatus of claim 1, further comprising an out-feed system, the out-feed system comprising:

an out-feed conveyor positioned in line with the cross-tie conveyor and configured to receive the cross-tie with the at least two tie-plates affixed thereto;

a finished cross-tie conveyor configured to receive the cross-tie with the at least two tie-plates affixed thereto;

a lifting mechanism engaging the out-feed conveyor and configured to lift the out-feed conveyor to move the cross-tie with the at least two tie-plates affixed thereto onto the finished cross-tie conveyor.

7. The apparatus of claim 6, wherein the lifting mechanism comprises a hydraulic cylinder.

8. The apparatus of claim 1, further comprising:

at least one control mechanism attached to the cross-tie conveyor and configured to manipulate the apparatus;

at least one guard connected to the cross-tie conveyor and disposed above the at least one control mechanism, the at least one guard selectively positionable in at least two positions, comprising a first position and a second position; and wherein in the first position the at least one guard is disposed above the at least one control mechanism and in the second position the at least one guard is perpendicularly disposed in front of at least one of the cross-tie positioning mechanisms.

9. The apparatus of claim 1, wherein the stop member comprises at least one stop shim, the stop shim removably mounted on the stop member and configured to control the position of the cross-tie on the cross-tie conveyor.

10. The apparatus of claim 1, wherein the positioning member comprises a generally cylindrical member oriented parallel to the positioning rail.

11. The apparatus of claim 10, wherein the positioning member comprises a hydraulic cylinder connected to the cylindrical member and configured to position the generally cylindrical member against the positioning rail.

12. The apparatus of claim 1, wherein each of the at least two tie-plate positioning mechanisms further comprises a hydraulic cylinder connected to the tie-plate positioning member and is configured to position the tie-plate on the cross-tie.

13. The apparatus of claim 12, wherein each of the at least two tie-plate positioning mechanisms further comprises a tie-plate container configured to retain at least two vertically stacked tie-plates.

14. The apparatus of claim 13, wherein the pre-plate container further comprises at least one tie-plate shim placed within the tie-plate container to align the at least two vertically stacked tie-plates.

15. The apparatus of claim 1, wherein the gauge comprises at least two plate engaging portions having a width substantially equal to the width of a railroad rail and a gauge member connected to the at least two plate engaging portions.

16. The apparatus of claim 15, wherein the length between the at least two plate engaging portions is substantially equal to the distance between two railroad rails.

17. The apparatus of claim 1, further comprising a diesel engine coupled to a hydraulic pump and configured to supply hydraulic fluid.

18. The apparatus of claim 17, further comprising at least one hydraulic cooler coupled to the hydraulic pump and configured to cool the hydraulic fluid.

19. The apparatus of claim 1, further comprising a frame, the frame connected to and supporting the cross-tie conveyor and the at least two plate positioning mechanisms.

* * * * *